US010787750B2

(12) United States Patent
Bocarsly et al.

(10) Patent No.: US 10,787,750 B2
(45) Date of Patent: Sep. 29, 2020

(54) REDUCING CARBON DIOXIDE TO PRODUCTS WITH AN INDIUM OXIDE ELECTRODE

(71) Applicants: The Trustees of Princeton University, Princeton, NJ (US); Avantium Knowledge Centre B.V., Amsterdam (NL)

(72) Inventors: Andrew B. Bocarsly, Plainsboro, NJ (US); Zachary M. Detweiler, Plainsboro, NJ (US)

(73) Assignees: The Trustees of Princeton University, Princeton, NJ (US); Avantium Knowledge Centre B.V., Amsterdam (NL)

( * ) Notice: Subject to any disclaimer, the term of this patent is extended or adjusted under 35 U.S.C. 154(b) by 0 days.

(21) Appl. No.: 16/152,852

(22) Filed: Oct. 5, 2018

(65) Prior Publication Data

US 2019/0032229 A1 Jan. 31, 2019

Related U.S. Application Data

(62) Division of application No. 14/422,322, filed as application No. PCT/US2013/056457 on Aug. 23, 2013, now Pat. No. 10,100,417.

(Continued)

(51) Int. Cl.
*C25B 9/00* (2006.01)
*C25B 9/06* (2006.01)

(Continued)

(52) U.S. Cl.
CPC ..... *C25B 3/04* (2013.01); *C25B 9/08* (2013.01); *C25B 11/04* (2013.01); *C25B 11/0452* (2013.01); *C25D 11/34* (2013.01)

(58) Field of Classification Search
CPC .... C25B 3/04; C25B 9/00; C25B 9/06; C25B 9/12; C25B 9/206; C25C 7/02; C25C 7/00; C25C 3/08

(Continued)

(56) References Cited

U.S. PATENT DOCUMENTS

2007/0054170 A1* 3/2007 Isenberg ..... H01B 1/122 204/424
2012/0132538 A1* 5/2012 Cole ..... C25B 3/04 205/450

OTHER PUBLICATIONS

Hori et al., Electrocatalytic process of CO selectivity in electrochemical reduction of CO2 at metal electrodes in aqueous media, Electrochimica Acta, vol. 39, No. 11-12, Aug. 1, 1994, pp. 1833-1839.

(Continued)

*Primary Examiner* — Zulmariam Mendez
(74) *Attorney, Agent, or Firm* — Suiter Swantz pc llo

(57) ABSTRACT

A method reducing carbon dioxide to one or more organic products may include steps (A) to (E). Step (A) may introduce an anolyte to a first compartment of an electrochemical cell. The first compartment may include an anode. Step (B) may introduce a catholyte and carbon dioxide to a second compartment of the electrochemical cell. Step (C) may oxidize an indium cathode to produce an oxidized indium cathode. Step (D) may introduce the oxidized indium cathode to the second compartment. Step (E) may apply an electrical potential between the anode and the oxidized indium cathode sufficient for the oxidized indium cathode to reduce the carbon dioxide to a reduced product.

2 Claims, 11 Drawing Sheets

Related U.S. Application Data

(60) Provisional application No. 61/692,293, filed on Aug. 23, 2012.

(51) Int. Cl.

| | |
|---|---|
| ***C25C 7/02*** | (2006.01) |
| ***C25C 7/00*** | (2006.01) |
| ***C25C 3/08*** | (2006.01) |
| ***C25B 3/04*** | (2006.01) |
| ***C25B 11/04*** | (2006.01) |
| ***C25D 11/34*** | (2006.01) |
| ***C25B 9/08*** | (2006.01) |

(58) Field of Classification Search
USPC ..... 204/230.2
See application file for complete search history.

(56) References Cited

OTHER PUBLICATIONS

S. Kapusta, The Electroreduction of Carbon Dioxide and Formic Acid on Tin and Indium Electrodes, Journal of the Electrochemical Society, vol. 130, No. 3, Jan. 1, 1983, pp. 607-613.
Z. Detweiler et al., Anodized Indium Metal Electrodes for Enhanced Carbon Dioixde Reduction in Aqueous Electrolyte, Langmuir, 2014, pp. 7593-7599.
Supplementary European Search Report for European Application No. 13830513.1 dated Aug. 17, 2015, 7 pages.
Response to Summons to attend Oral Proceedings for European Application No. 13830513.1 dated Aug. 11, 2017, 8 pages.

* cited by examiner

REDUCING CARBON DIOXIDE TO PRODUCTS WITH AN INDIUM OXIDE ELECTRODE

CROSS REFERENCE TO RELATED APPLICATIONS

The present application claimed the benefit under 35 U.S.C. § 120 of U.S. patent application Ser. No. 14/422,322 filed Feb. 18, 2015. U.S. patent application Ser. No. 14/422,322 filed Feb. 18, 2015 is a 371 of international patent application PCTUS 1356457 filed on Aug. 23, 2013. PCTUS 1356457 filed on Aug. 23, 2013 claims the benefit of U.S. Provisional Patent Application Ser. No. 61/692,293 filed Aug. 23, 2012. The U.S. patent application Ser. No. 14/422,322 filed Feb. 18, 2015, PCTUS 1356457 filed on Aug. 23, 2013, and U.S. Provisional Patent Application Ser. No. 61/692,293 filed Aug. 23, 2012 are hereby incorporated by reference in their entireties.

GOVERNMENT INTERESTS

This invention was made with U.S. government support under Grant CHE-0911114 awarded by the National Science Foundation. The U.S. government has certain rights in the invention.

FIELD

The present invention relates to chemical reduction generally and, more particularly, to a method and/or apparatus for the reduction of carbon dioxide to products.

BACKGROUND

The combustion of fossil fuels in activities such as the electricity generation, transportation, and manufacturing produces billions of tons of carbon dioxide annually. Research since the 1970s indicates increasing concentrations of carbon dioxide in the atmosphere may be responsible for altering the Earth's climate, changing the pH of the ocean and other potentially damaging effects. Countries around the world, including the United States, are seeking ways to mitigate emissions of carbon dioxide.

A mechanism for mitigating emissions is to convert carbon dioxide into economically valuable materials such as fuels and industrial chemicals. If the carbon dioxide is converted using energy from renewable sources, both mitigation of carbon dioxide emissions and conversion of renewable energy into a chemical form that can be stored for later use will be possible. Electrochemical and photochemical pathways are means for the carbon dioxide conversion.

SUMMARY OF THE PREFERRED EMBODIMENTS

The present disclosure concerns a method for the electrochemical reduction of carbon dioxide. The method may include introducing an anolyte to a first compartment of an electrochemical cell, where the first compartment includes an anode. The method may also include introducing a catholyte and carbon dioxide to a second compartment of the electrochemical cell. The method may also include oxidizing an indium cathode to produce an oxidized indium cathode. The method may also include introducing the oxidized indium cathode to the second compartment. The method may further include applying an electrical potential between the anode and the oxidized indium cathode sufficient for the oxidized indium cathode to reduce the carbon dioxide to a reduced product.

The present disclosure concerns a method for the electrochemical reduction of carbon dioxide. The method may include introducing an anolyte to a first compartment of an electrochemical cell, where the first compartment includes an anode. The method may also include introducing a catholyte and carbon dioxide to a second compartment of the electrochemical cell, where the second compartment includes an anodized indium cathode. The method may further include applying an electrical potential between the anode and the anodized indium cathode sufficient for the anodized indium cathode to reduce the carbon dioxide to at least formate.

The present disclosure concerns a system for electrochemical reduction of carbon dioxide. The system may include an electrochemical cell which includes a first cell compartment, an anode positioned within the first cell compartment, a second cell compartment, a separator interposed between the first cell compartment and the second cell compartment, the second cell compartment containing an electrolyte, and an anodized indium cathode positioned within the second cell compartment. The system may further include an energy source operably coupled with the anode and the anodized indium cathode, where the energy source is configured to apply a voltage between the anode and the anodized indium cathode to reduce carbon dioxide at the anodized indium cathode to at least formate.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

Figure 1:
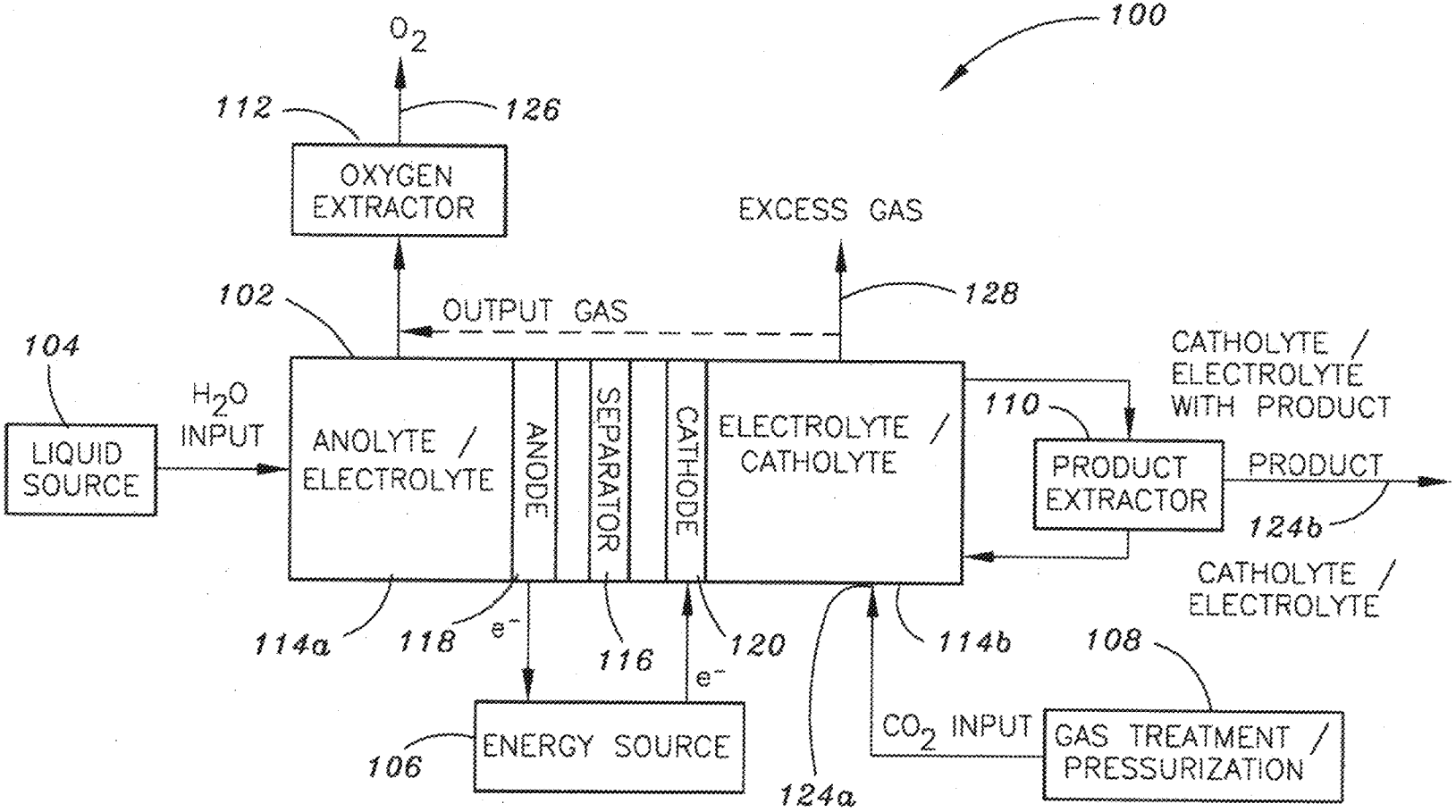
FIG. 1 is a block diagram of a system in accordance with a preferred embodiment of the present invention.

In accordance with some embodiments of the present invention, an electro-catalytic system is provided that generally allows carbon dioxide to be converted to reduced species in an aqueous solution. Preferred embodiments employ an anodized indium electrode for the reduction of carbon dioxide. An electrode may be chemically treated to produce an anodized electrode for implementation in a preferred system. Some embodiments generally relate to conversion of carbon dioxide to reduced organic products, such as formate. Efficient conversion of carbon dioxide has been found at low reaction overpotentials.

Some embodiments of the present invention thus relate to environmentally beneficial methods for reducing carbon dioxide. The methods generally include electrochemically reducing the carbon dioxide in an aqueous, electrolyte-supported divided electrochemical cell that includes an anode (e.g., an inert conductive counter electrode) in a cell compartment and a conductive cathode in another cell compartment. An anodized indium electrode may provide an electrocatalytic function to produce a reduced product.

The use of processes for converting carbon dioxide to reduced organic and/or inorganic products in accordance with some embodiments of the invention generally has the potential to lead to a significant reduction of carbon dioxide, a major greenhouse gas, in the atmosphere and thus to the mitigation of global warming. Moreover, some embodiments may advantageously produce formate and related products without adding extra reactants, such as a hydrogen source, and without employing additional catalysts.

Before any embodiments of the invention are explained in detail, it is to be understood that the embodiments may not be limited in application per the details of the structure or the function as set forth in the following descriptions or illustrated in the figures of the drawing. Different embodiments may be capable of being practiced or carried out in various ways. Also, it is to be understood that the phraseology and terminology used herein is for the purpose of description and should not be regarded as limiting. The use of terms such as "including," "comprising," or "having" and variations thereof herein are generally meant to encompass the item listed thereafter and equivalents thereof as well as additional items. Further, unless otherwise noted technical terms may be used according to conventional usage.

In the following description of methods and systems, process steps may be carried out over a range of values, where numerical ranges recited herein generally include all values from the lower value to the upper value (e.g., all possible combinations of numerical values between (and including) the lowest value and the highest value enumerated are considered expressly stated). For example, if a concentration range or beneficial effect range is stated as 1% to 50%, it is intended that values such as 2% to 40%, 10% to 30%, or 1% to 3%, etc., are expressly enumerated. The above may be simple examples of what is specifically intended.

A use of electrochemical reduction of carbon dioxide, tailored with particular electrodes, may produce formate and related with relatively high faradaic efficiency, such as approaching 70% at an electric potential of about −1.6 volts (V) with respect to a saturated calomel electrode (SCE).

The reduction of the carbon dioxide may be suitably achieved efficiently in a divided electrochemical in which (i) a compartment contains an anode that is an inert counter electrode and (ii) another compartment contains a working cathode electrode. The compartments may be separated by a porous glass frit or other ion conducting bridge. Both compartments generally contain an aqueous solution of an electrolyte. Carbon dioxide gas may be continuously bubbled through the cathodic electrolyte solution to saturate the solution, may be provided via adding fresh electrolyte containing carbon dioxide, or may be supplied to the electrolytic cell on a batch or periodic basis.

Advantageously, the carbon dioxide may be obtained from any sources (e.g., an exhaust stream from fossil-fuel burning power or industrial plants, from geothermal or natural gas wells or the atmosphere itself). Most suitably, the carbon dioxide may be obtained from concentrated point sources of generation prior to being released into the atmosphere. For example, high concentration carbon dioxide sources may frequently accompany natural gas in amounts of 5% to 50%, and may exist in flue gases of fossil fuel (e.g., coal, natural gas, oil, etc.) burning power plants. Nearly pure carbon dioxide may be exhausted from cement factories and from fermenters used for industrial fermentation of ethanol. Certain geothermal steams may also contain significant amounts of carbon dioxide. The carbon dioxide emissions from varied industries, including geothermal wells, may be captured on-site. Separation of the carbon dioxide from such exhausts is known. Thus, the capture and use of existing atmospheric carbon dioxide in accordance with some embodiments of the present invention generally allow the carbon dioxide to be a renewable and essentially unlimited source of carbon.

Referring to FIG. 1, a block diagram of a system 100 is shown in accordance with an embodiment of the present invention. System 100 may be utilized for electrochemical reduction of carbon dioxide to reduced organic products, preferably formate. The system (or apparatus) 100 generally comprises a cell (or container) 102, a liquid source 104 (preferably a water source, but may include an organic solvent source), an energy source 106, a gas source 108 (preferably a carbon dioxide source), a product extractor 110 and an oxygen extractor 112. A product or product mixture may be output from the product extractor 110 after extraction. An output gas containing oxygen may be output from the oxygen extractor 112 after extraction.

The cell 102 may be implemented as a divided cell, preferably a divided electrochemical cell. The cell 102 is generally operational to reduce carbon dioxide ($CO_2$) into products or product intermediates. In particular implementations, the cell 102 is operational to reduce carbon dioxide to formate. The reduction generally takes place by introducing (e.g., bubbling) carbon dioxide into an electrolyte solution in the cell 102. A cathode 120 in the cell 102 may reduce the carbon dioxide into a product or a product mixture.

The cell 102 generally comprises two or more compartments (or chambers) 114*a*-114*b*, a separator (or membrane) 116, an anode 118, and a cathode 120. The anode 118 may be disposed in a given compartment (e.g., 114*a*). The cathode 120 may be disposed in another compartment (e.g., 114*b*) on an opposite side of the separator 116 as the anode 118. In particular implementations, the cathode 120 includes materials suitable for the reduction of carbon dioxide including indium, and in particular, indium oxides or anodized indium. The cathode 120 may be prepared such that an indium oxide layer is purposefully introduced to the cathode 120. An electrolyte solution 122 (e.g., anolyte or catholyte 122) may fill both compartments 114*a*-114*b*. The aqueous solution 122 preferably includes water as a solvent and water soluble salts for providing various cations and anions in solution, however an organic solvent may also be utilized. In certain implementations, the organic solvent is present in an aqueous solution, whereas in other implementations the organic solvent is present in a non-aqueous solution. The electrolyte 122 may include one or more of $Na_2SO_4$, KCl, $NaNO_3$, NaCl, NaF, $NaClO_4$, $KClO_4$, $K_2SiO_3$, $CaCl_2$), a guanidinium cation, a W ion, an alkali metal cation, an ammonium cation, an alkylammonium cation, a halide ion, an alkyl amine, a borate, a carbonate, a guanidinium derivative, a nitrite, a nitrate, a phosphate, a polyphosphate, a perchlorate, a silicate, a sulfate, and a tetraalkyl ammonium salt. In particular implementations, the electrolyte 122 includes potassium sulfate.

As described herein, the cathode 120 may include an indium oxide or anodized indium, where the indium oxide (e.g., a layer thereof) is purposefully implemented on the cathode 120. Electrochemical reduction of carbon dioxide at an indium electrode may generate formate with relatively high Faradaic efficiency, however, such processes generally require relatively high overpotential, with poor electrode stability. At moderate cathode potentials, the Faradaic efficiency for formate production at indium metal electrodes may be improved when an oxide layer is electrolytically formed on the indium electrode. These indium oxide films may improve the stability of the carbon dioxide reduction over that of indium metal without the oxide layer. In particular implementations, the oxide layer is formed by introducing an indium electrode to a hydroxide solution, such as an alkali metal hydroxide solution, preferably potassium hydroxide, in an electrochemical system. The indium electrode may be anodized via application of a potential to the electrochemical system. It is contemplated that the electrochemical system utilized for anodizing the indium electrode may be system 100, may be separate system, or may be a combination of system 100 and another electrochemical system. In a particular implementation, the indium electrode is anodized in a potassium hydroxide aqueous solution at +3V vs SCE until the surface of the metal is visibly altered by formation of indium oxide (which may provide a black coloration to the electrode).

The liquid source 104 preferably includes a water source, such that the liquid source 104 may provide pure water to the cell 102. The liquid source 104 may provide other fluids to the cell 102, including an organic solvent, such as methanol, acetonitrile, and dimethylfuran. The liquid source 104 may also provide a mixture of an organic solvent and water to the cell 102.

The energy source 106 may include a variable voltage source. The energy source 106 may be operational to generate an electrical potential between the anode 118 and the cathode 120. The electrical potential may be a DC voltage. In preferred embodiments, the applied electrical potential is generally between about −1.0V vs. SCE and about −4V vs. SCE, preferably from about −1.3V vs. SCE to about −3V vs. SCE, and more preferably from about −1.4 V vs. SCE to about −2.0V vs. SCE.

The gas source 108 preferably includes a carbon dioxide source, such that the gas source 108 may provide carbon dioxide to the cell 102. In some embodiments, the carbon dioxide is bubbled directly into the compartment 114*b* containing the cathode 120. For instance, the compartment 114*b* may include a carbon dioxide input, such as a port 124*a* configured to be coupled between the carbon dioxide source and the cathode 120.

The product extractor 110 may include an organic product and/or inorganic product extractor. The product extractor 110 generally facilitates extraction of one or more products (e.g., formate) from the electrolyte 122. The extraction may occur via one or more of a solid sorbent, carbon dioxide-assisted solid sorbent, liquid-liquid extraction, nanofiltration, and electrodialysis. The extracted products may be presented through a port 124*b* of the system 100 for subsequent storage, consumption, and/or processing by other devices and/or processes. For instance, in particular implementations, formate is continuously removed from the cell 102, where cell 102 operates on a continuous basis, such as through a continuous flow-single pass reactor where fresh catholyte and carbon dioxide is fed continuously as the input, and where the output from the reactor is continuously removed. In other preferred implementations, formate is continuously removed from the catholyte 122 via one or more of adsorbing with a solid sorbent, liquid-liquid extraction, and electrodialysis. Batch processing and/or intermittent removal of product is also contemplated.

The oxygen extractor 112 of FIG. 1 is generally operational to extract oxygen byproducts (e.g., $O_2$) created by the reduction of the carbon dioxide and/or the oxidation of water. In preferred embodiments, the oxygen extractor 112 is a disengager/flash tank. The extracted oxygen may be presented through a port 126 of the system 100 for subsequent storage and/or consumption by other devices and/or processes. Chlorine and/or oxidatively evolved chemicals may also be byproducts in some configurations, such as in an embodiment of processes other than oxygen evolution occurring at the anode 118. Such processes may include chlorine evolution, oxidation of organics to other saleable products, waste water cleanup, and corrosion of a sacrificial anode. Any other excess gases (e.g., hydrogen) created by the reduction of the carbon dioxide and water may be vented from the cell 102 via a port 128.

Figure 2A:
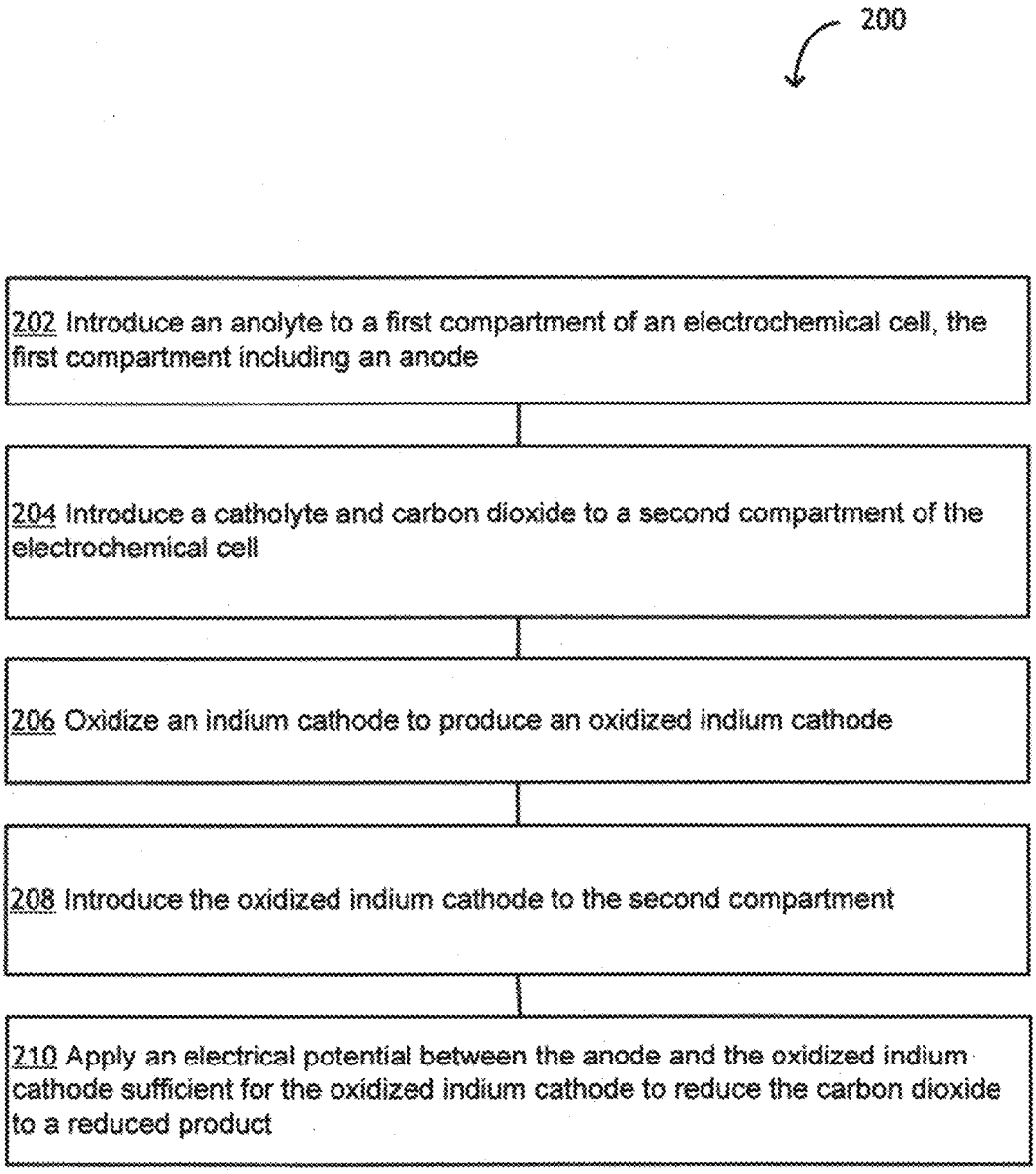
FIG. 2A is a flow diagram of an example method for the electrochemical reduction of carbon dioxide.

Referring to FIG. 2A, a flow diagram of an example method 200 for the electrochemical reduction of carbon dioxide is shown. The method (or process) 200 generally comprises a step (or block) 202, a step (or block) 204, a step (or block) 206, a step (or block) 208 and a step (or block) 210. The method 200 may be implemented using the system 100.

Step 202 may introduce an anolyte to a first compartment of an electrochemical cell. The first compartment of the electrochemical cell may include an anode. Step 204 may introduce a catholyte and carbon dioxide to a second compartment of the electrochemical cell. Step 206 may oxidize an indium cathode to produce an oxidized indium cathode. Step 208 may introduce the oxidized indium cathode to the second compartment. Step 210 may apply an electrical potential between the anode and the oxidized indium cathode sufficient for the oxidized indium cathode to reduce the carbon dioxide to a reduced product.

It is contemplated that step 206 may include introducing the indium cathode to a hydroxide solution and electrochemically oxidizing the indium cathode to produce the oxidized indium cathode. In particular implementations, the hydroxide solution includes an alkali metal hydroxide, particularly potassium hydroxide. Electrochemically oxidizing the indium cathode to produce the oxidized indium cathode may involve applying a potential of about +3V vs SCE to the indium cathode to produce the oxidized indium cathode.

Figure 2B:
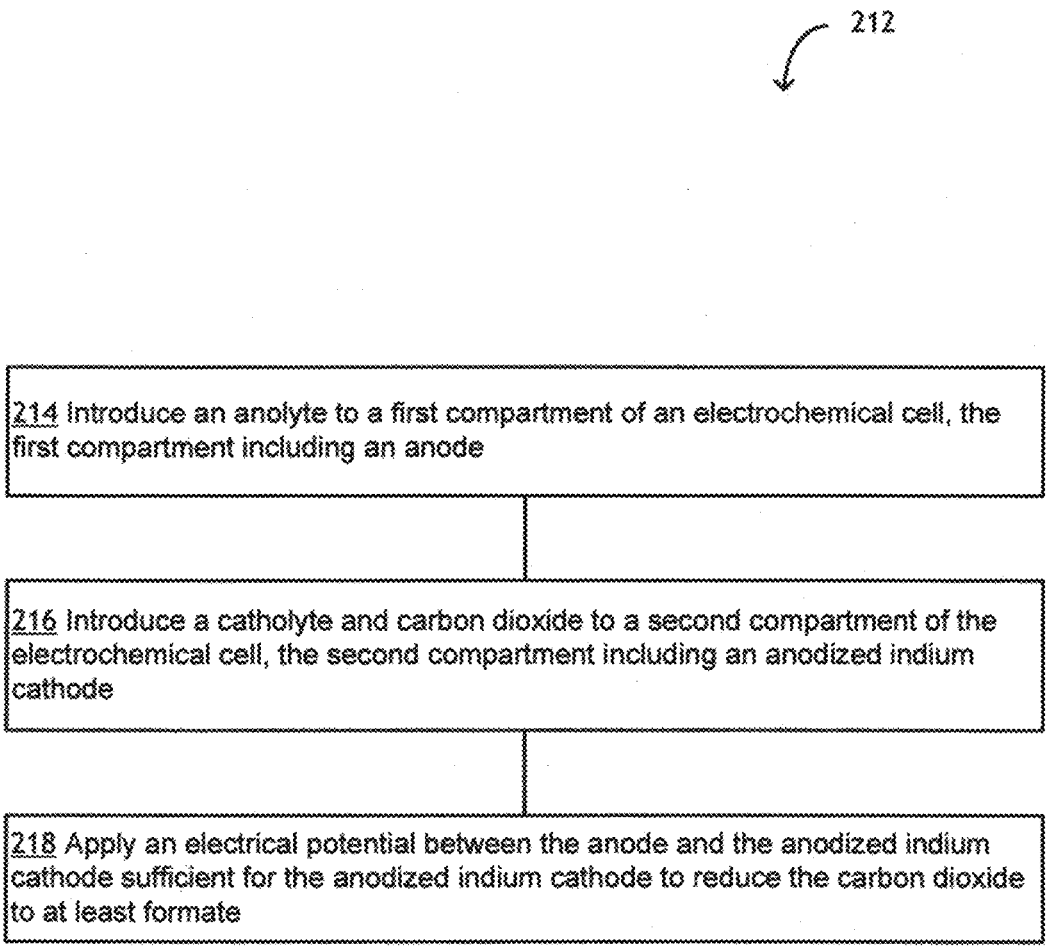
FIG. 2B is a flow diagram of another example method for the electrochemical reduction of carbon dioxide.

Referring to FIG. 2B, a flow diagram of another example method 212 for the electrochemical reduction of carbon dioxide is shown. The method (or process) 212 generally comprises a step (or block) 214, a step (or block) 216, and a step (or block) 218. The method 212 may be implemented using the system 100.

Step 214 may introduce an anolyte to a first compartment of an electrochemical cell. The first compartment of the electrochemical cell may include an anode. Step 216 may introduce a catholyte and carbon dioxide to a second compartment of the electrochemical cell. The second compartment of the electrochemical cell may include an anodized indium cathode. Step 218 may apply an electrical potential between the anode and the anodized indium cathode sufficient for the anodized indium cathode to reduce the carbon dioxide to at least formate.

It is contemplated that method 212 may further include introducing an indium cathode to a hydroxide solution and electrochemically oxidizing the indium cathode to produce the anodized indium cathode.

The effective electrochemical/photoelectrochemical reduction of carbon dioxide disclosed herein may provide new methods of producing methanol and other related products in an improved, efficient, and environmentally beneficial way, while mitigating carbon dioxide-caused climate change (e.g., global warming). Moreover, the methanol product of reduction of carbon dioxide may be advantageously used as (1) a convenient energy storage medium, which allows convenient and safe storage and handling, (2) a readily transported and dispensed fuel, including for methanol fuel cells and (3) a feedstock for synthetic hydrocarbons and corresponding products currently obtained from oil and gas resources, including polymers, biopolymers and even proteins, that may be used for animal feed or human consumption. Importantly, the use of methanol as an energy storage and transportation material generally eliminates many difficulties of using hydrogen for such purposes. The safety and versatility of methanol generally makes the disclosed reduction of carbon dioxide further desirable.

Some embodiments of the present invention may be further explained by the following examples, which should not be construed by way of limiting the scope of the invention.

Example 1: Comparative Experiment

Cyclic voltammetry and bulk electrolysis were performed in solutions of 0.5M $K_2SO_4$ at pH of 4.80 under $CO_2$ atmosphere and under Ar atmosphere. All potentials were referenced to the saturated calomel electrode (SCE). Standard three electrode cells utilized a platinum mesh counter electrode. Bulk electrolyses were carried out in an H-type cell to prevent products from re-oxidizing at the platinum anode. CHI 760/1100 potentiostats were used for cyclic voltammetry and PAR 173 potentiostats with PAR 174A and 379 current to voltage converter coulometers were used for bulk electrolysis.

Indium electrodes were fabricated by hammering indium shot (99.9% Alfa Aesar) into flat, 1 $cm^2$ electrodes. For oxide free experiments, electrodes were etched in 6M HCl for several minutes to remove native oxide. To prepare electrodes with excess oxide, indium was anodized in 1M KOH aqueous solution at +3V vs SCE until the surface of the metal was visibly black (about 30 seconds). Electrolysis products were analyzed using a Bruker 500 MHz NMR with a cryoprobe detector. A water suppression subroutine allowed direct detection of products in the electrolyte at the micromolar level. Dioxane was used as an internal standard.

An x-ray photoelectron spectroscopy (XPS) analysis was performed using a VG Scientific Mk II ESCALab with a magnesium salt anode and HSA electron analyzer set at 20 eV pass energy. Shifts were calibrated to the $4f_{7/2}$ Au peak at 84.00 eV from gold foil attached to the sample. High resolution scans were performed using a Specs XPS with a monochromated, aluminum salt anode and Phoibos HSA electron analyzer at 20 eV pass energy. XPS spectra were interpreted using CasaXPS peak fitting software.

Attenuated total reflectance infrared (ATR-IR) spectra were collected at a 4 $cm^{-1}$ resolution using a Nicolet 6700 FT-IR with MCT detector, and a diamond ATR crystal. Spectra were taken at a 45° incident angle and adjusted using the ATR correction method included with the Omnic software.

A Quanta 200 FEG ESEM was employed to obtain electron micrographs and grazing incident angle XRD diffractograms were obtained with a Bruker D8 Discover x-ray diffractometer.

Figure 3A:
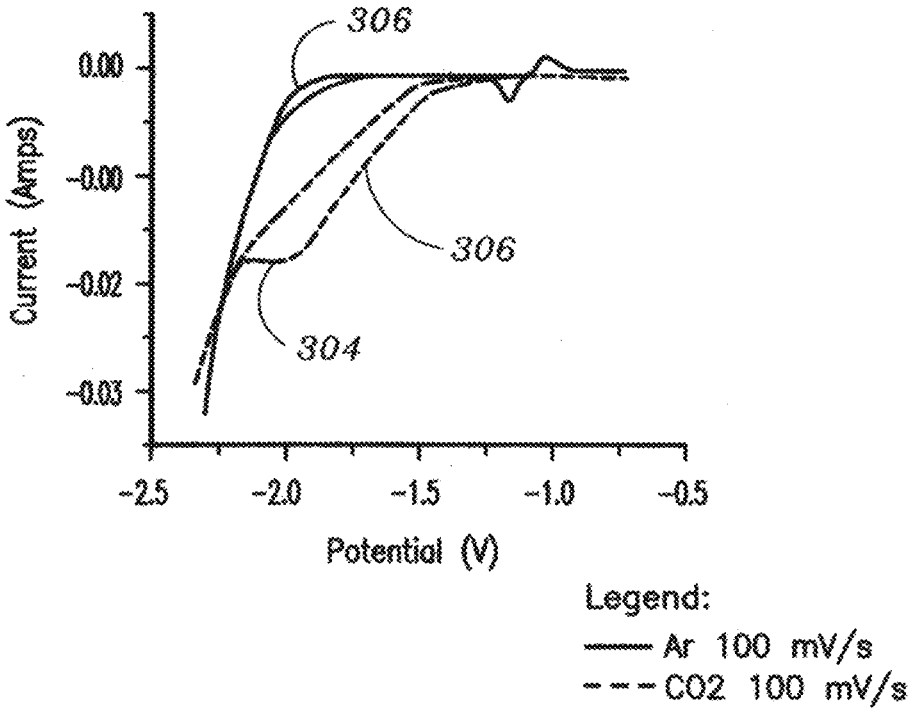
FIG. 3A is a current versus potential graph for an indium electrode in an argon atmosphere and in a carbon dioxide atmosphere.
Figure 3B:
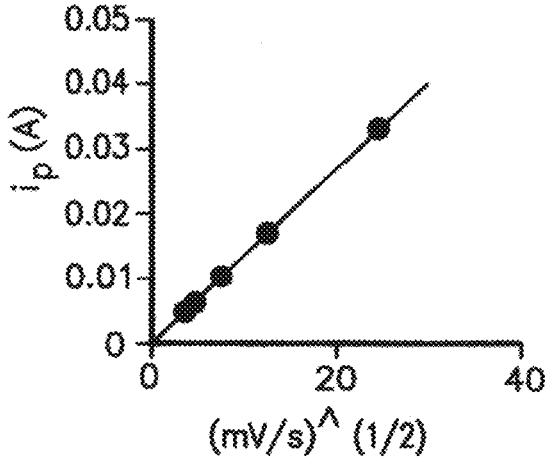
FIG. 3B is a peak current versus square root of scan rate graph for the system with the indium electrode of FIG. 3A with the carbon dioxide atmosphere.
Figure 3C:
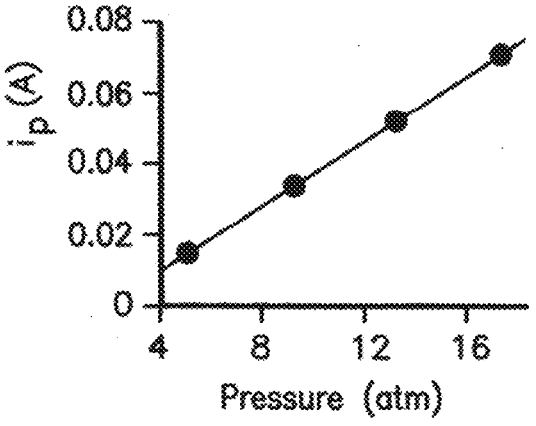
FIG. 3C is a peak current versus pressure graph for the system with the indium electrode of FIG. 3A with corresponding carbon dioxide partial pressure.

Results:

Cyclic voltammetry was employed in order to determine $CO_2$ activity at the indium electrode surface. FIG. 3A is a current versus potential graph for an indium electrode in an argon atmosphere and in a carbon dioxide atmosphere. FIG. 3A communicates the redox behavior at the indium electrode, where curve 302 shows the onset of $CO_2$ reduction at around −1.2V vs SCE (SCE reference employed for all data presented) and a peak current 304 around −1.9V at 100 mV/s. Curve 306 shows data where the indium electrode is scanned over the same potential range under an Ar atmosphere, where the data is consistent with the assignment of waves in curve 302 to $CO_2$ reduction. Under an Ar atmosphere a large reductive current onsets at ~2.0V. After scanning this region of cathodic current, follow up scans yield a redox couple that grows in around −1.15V. This behavior indicated a presence of a blocking oxide layer on the indium surface that persists until ~2.0V, a potential that is significantly negative of the reported standard redox potentials of indium oxides ($E^O_{In(OH)3}$=−1.23V for $E^O_{In2O3}$=−1.27V). (CRC Handbook). Such metastable oxide layers may occur at other metal surfaces at highly reducing potentials. XPS data was taken as a function of electrode potential, by first holding the electrode at a specific negative potential for 2 minutes and then immediately removing the electrode from the cell, drying under a flow of nitrogen and obtaining XPS spectra showed an oxide was present (binding energy, 444.8 eV) at the electrode surface until a potential of ~2.2V was applied to the electrode. Under a $CO_2$ atmosphere, XPS analysis indicated that the surface oxide was not reduced, suggesting that $CO_2$ stabilizes these oxides and attests to the presence of a $CO_2$ and surface oxide interaction. FIG. 3B is a peak current versus square root of scan rate graph for the system with the indium electrode of FIG. 3A with the carbon dioxide atmosphere. With respect to FIG. 3B, a scan rate dependence taken under 1 atm of $CO_2$ yielded a linear dependence of peak current, $i_p$, with the square root of the scan rate, indicating a diffusion limited process is associated with the observed cathodic wave shown in curve 302 of FIG. 3A. The peak 304 in FIG. 3A associated with $CO_2$ reduction was observed to increase linearly with $CO_2$ pressure up to 250 psi, the highest pressure utilized, as provided in FIG. 3C. The first order dependence of the peak current $CO_2$ pressure further supports the assignment of the observed current to $CO_2$ reduction.

Figure 4A:
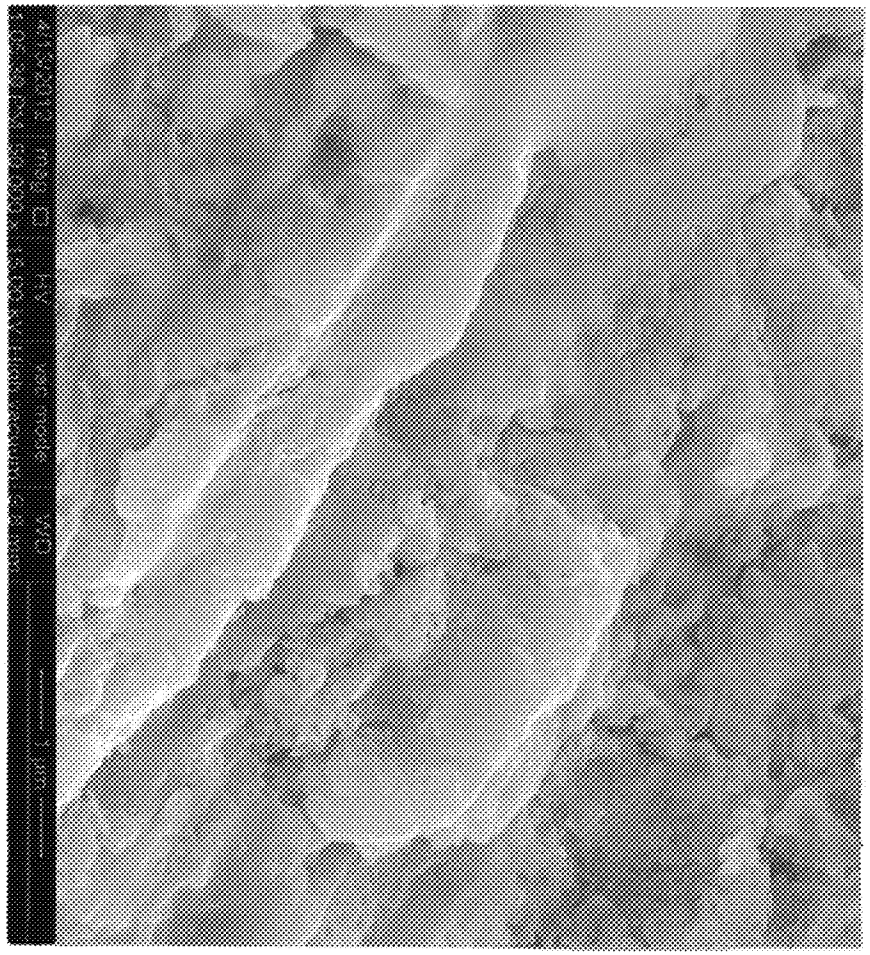
FIG. 4A is a scanning electron micrograph (SEM) image of the surface of an anodized indium electrode.
Figure 4C:
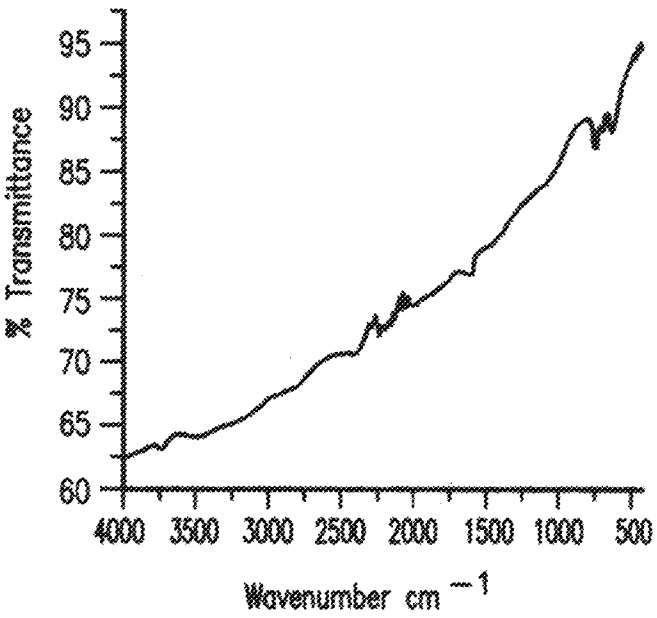
FIG. 4C is a graph of a vibrational spectrum analysis of the anodized indium electrode of FIG. 4A, showing percent transmittance versus wavenumber.
Figure 4B:
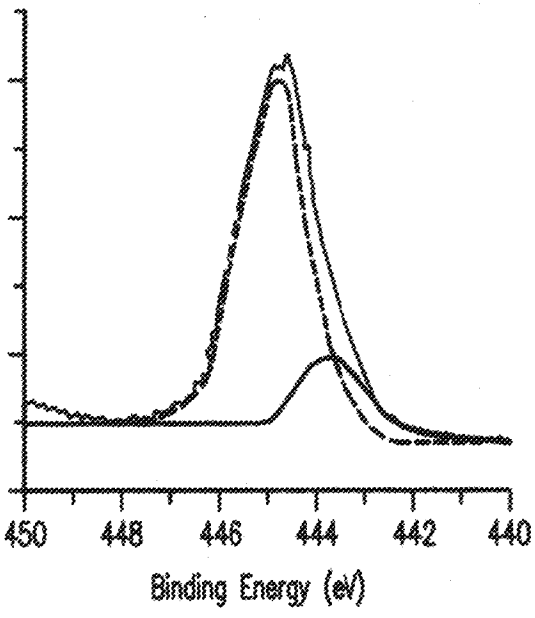
FIG. 4B is a graph of an x-ray photoelectron spectroscopy (XPS) analysis of the anodized indium electrode of FIG. 4A, showing counts at binding energies.
Figure 4D:
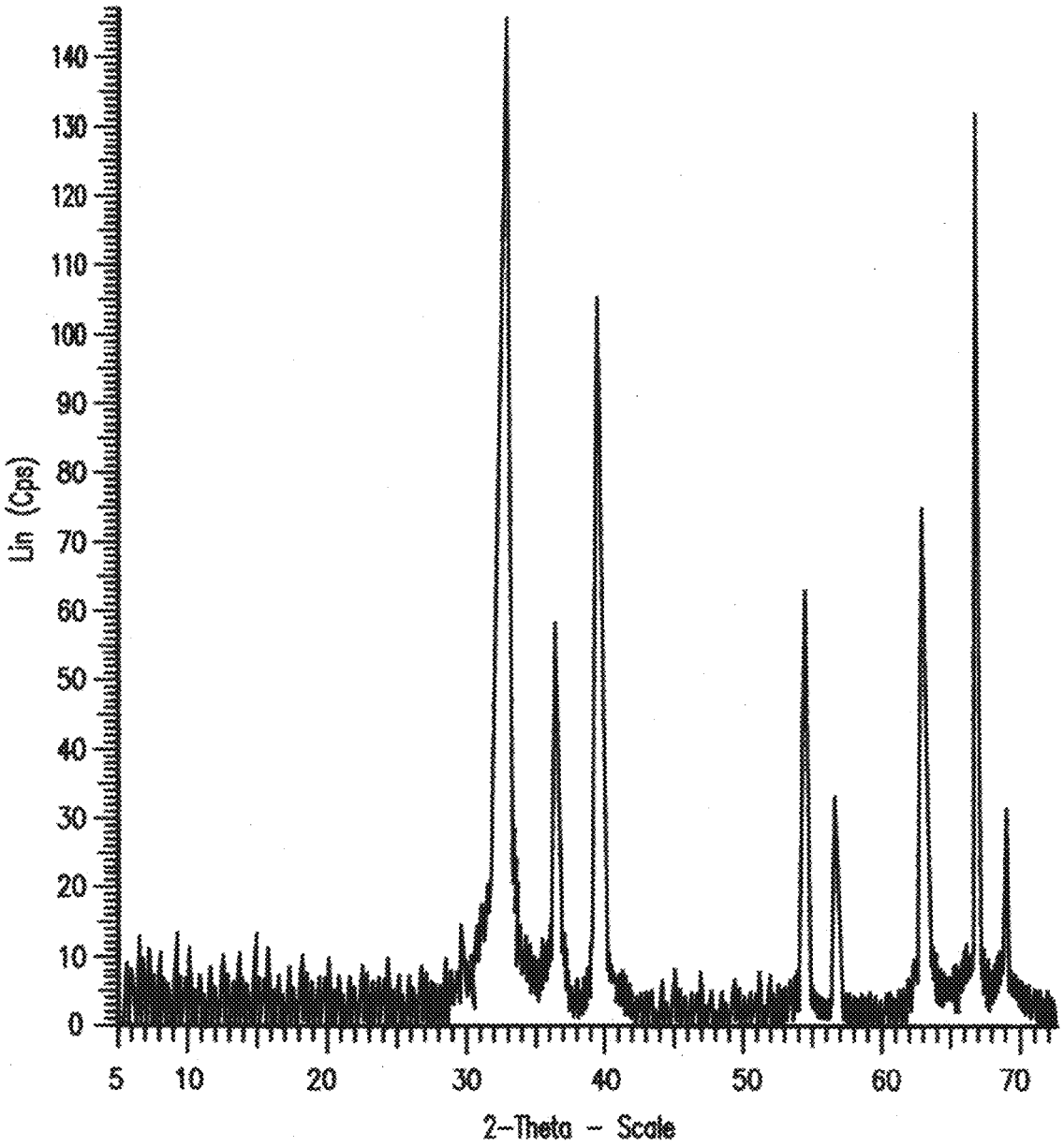
FIG. 4D is a graph of an x-ray diffraction (XRD) analysis of the anodized indium electrode of FIG. 4A, showing intensity at angles diffraction.

Bulk electrolysis at −1.4V in a two-compartment cell, followed by NMR analysis demonstrated that the product of $CO_2$ reduction was formate, indicating a 2-electron, 1-proton process. Electrodes containing a native oxide were found to reach a limiting current (at −1.4V) of 0.25 mA/cm$^2$, while acid etched electrodes reached a limiting current of 0.35 mA/cm$^2$. An initially determined Faradaic efficiency of 4% for the native oxide coated surface, outperformed etched electrodes, which yielded 2% Faradaic efficiency, upon passing 3C of charge. Thus, though kinetically limited with respect to charge transfer rate, the oxide coated surface is experimentally shown to be more effective at converting $CO_2$ to formate than the etched indium surface. This result suggested that the indium oxide interface might be electrocatalytic for the reduction of $CO_2$. To test this concept, a surface oxide was intentionally produced on the electrode surface. Growth of an oxide layer was performed in 1M KOH solution at +3V. At this potential, a black layer forms on the electrode surface within approximately 30 seconds. FIG. 4A shows an SEM image of the as grown, blackened indium electrode surface. The surface shows large features and is generally rough. XPS data provided in FIG. 4B shows that the as grown oxide interface contains indium with a binding energy 444.8 eV (which agrees with the In(III) species binding energy observed in an authentic sample of $In_2O_3$) as well as indium with a binding energy of 443.8 eV (corresponding to $In^0$). The vibrational spectrum of the anodized indium surface, provided in FIG. 4C, shows peaks at 615, 570 and 540 cm$^{-1}$, which is in agreement with standard $In_2O_3$ spectra (SDBS). XRD results, provided in FIG. 4D, show peaks at 30.6, 51.0 and 60.7 degrees, which indicate the presence of indium (III) oxide at the blackened surface in addition to characteristic indium metal peaks at 32.9, 36.3, 39.1, 54.3, 56.5, 63.1, 66.9 and 69.0 degrees. Bulk electrolysis at −1.4V using the blackened indium yields 11±1% Faradaic efficiency for formate production; a dramatic increase from the use of etched or native indium.

Figure 5:
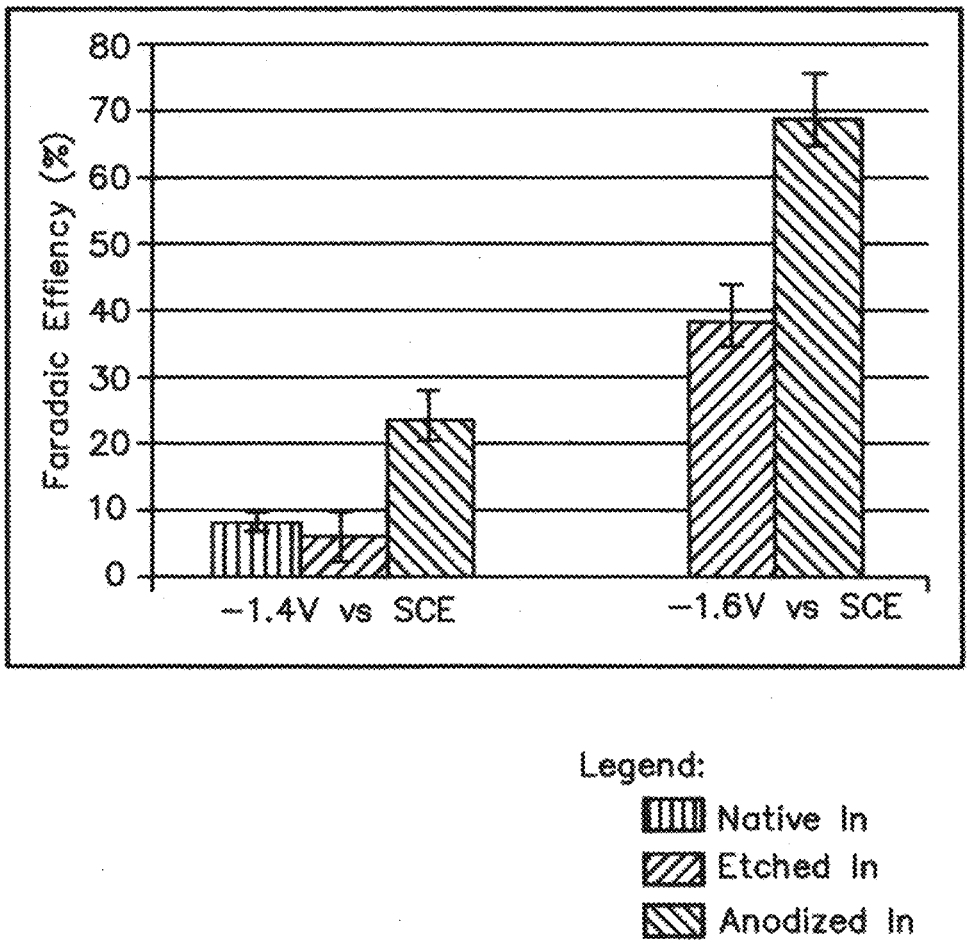
FIG. 5 is a graph of faradaic efficiency of various indium electrodes for bulk electrolysis at two potentials versus SCE.
Figure 6A:
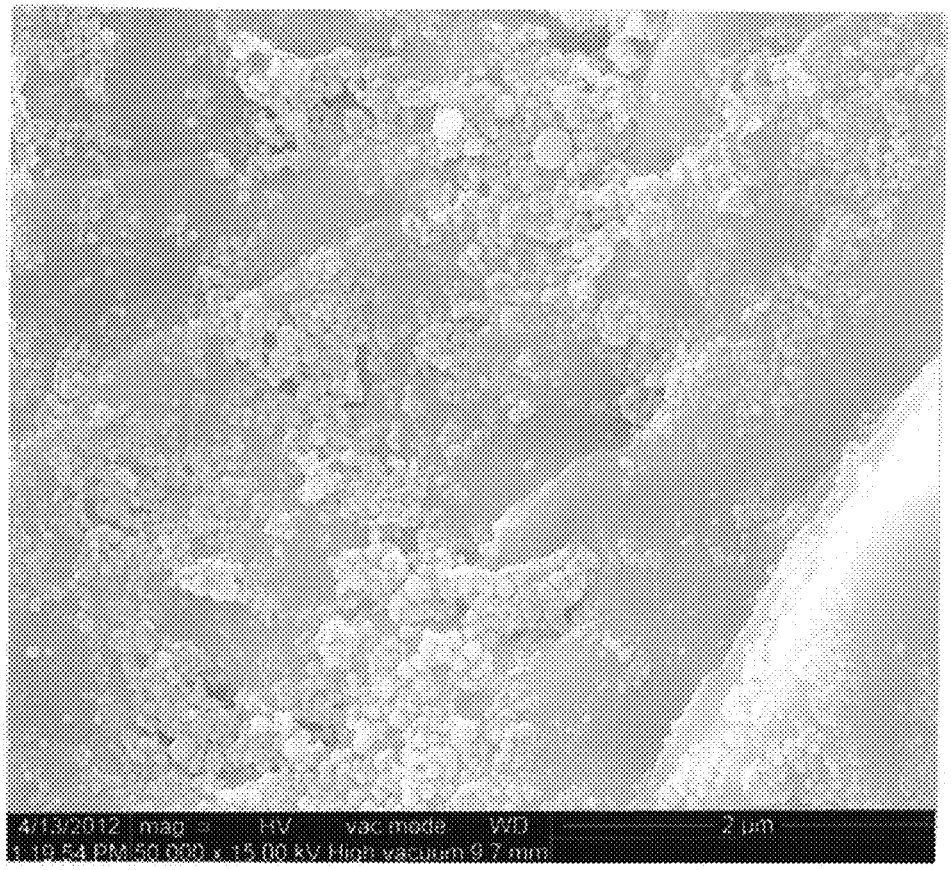
FIG. 6A is an SEM image of an anodized indium electrode after performing bulk electrolysis under a carbon dioxide atmosphere.
Figure 6C:
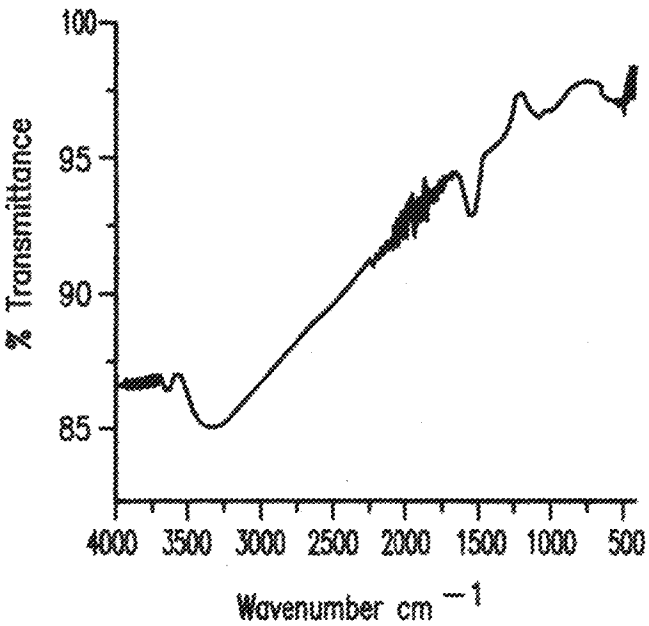
FIG. 6C is a graph of a vibrational spectrum analysis of the anodized indium electrode of FIG. 6A, showing percent transmittance versus wavenumber.
Figure 6B:
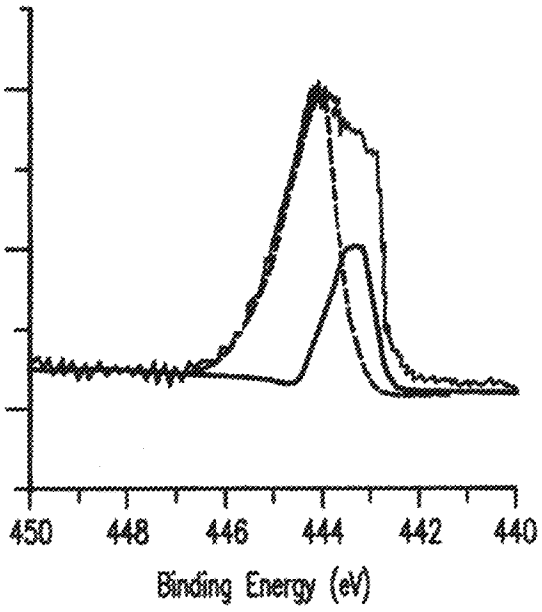
FIG. 6B is an XPS analysis of the anodized indium electrode of FIG. 6A, showing counts at binding energies.

Analogous electrolyses as those described above with reference to FIGS. 4B-4D were performed at −1.6V vs SCE. The results of the electrolyses at both −1.6 vs SCE and −1.4 vs SCE are provided in FIG. 5, where the anodized indium electrode (FIG. 4A) is experimentally shown to be more efficient at reducing $CO_2$ to formate than an acid etched indium electrode at both −1.4V vs SCE and −1.6V vs SCE. The reduction current of $CO_2$ bulk electrolyses using blackened (oxidized) indium electrodes was initially very high (20 mA/cm$^2$), but reduced within approximately 30 seconds to current densities slightly less than the average current densities at etched electrodes, 2 mA/cm$^2$ and 3 mA/cm$^2$, respectively, at −1.6V vs SCE. This is attributed to the initial reduction of indium oxide at the surface. After this electrode reduction, current stabilized and remained constant over the time frames observed (2 to 20 hrs.). After reaching a stable current the anodized indium, an SEM image (provided in FIG. 6A) showed that the electrode surface is covered with nanoparticles, which range from 20 nm to 100 nm in diameter. EDX analysis shows that these nanoparticles possess a higher oxygen to indium ratio than the smooth surface underneath. XPS data (provided in FIG. 6B) reveals that the oxidized indium peak at 444.8 eV decreases in relation to the indium metal peak at 443.8 eV. The ATR-IR spectra of a dry, used, anodized indium electrode (FIG. 6C) shows the presence of a hydroxyl group at 3392 cm−$^1$ and peaks at 1367, 1128, 593, and 505 cm−$^1$, which is in accord with literature spectra for $In(OH)_3$ (SDBS). There is also an unassigned peak at 1590 cm−$^1$ that could be attributed to the carbonyl stretch of a metal bound carbonyl group.

Figure 7:
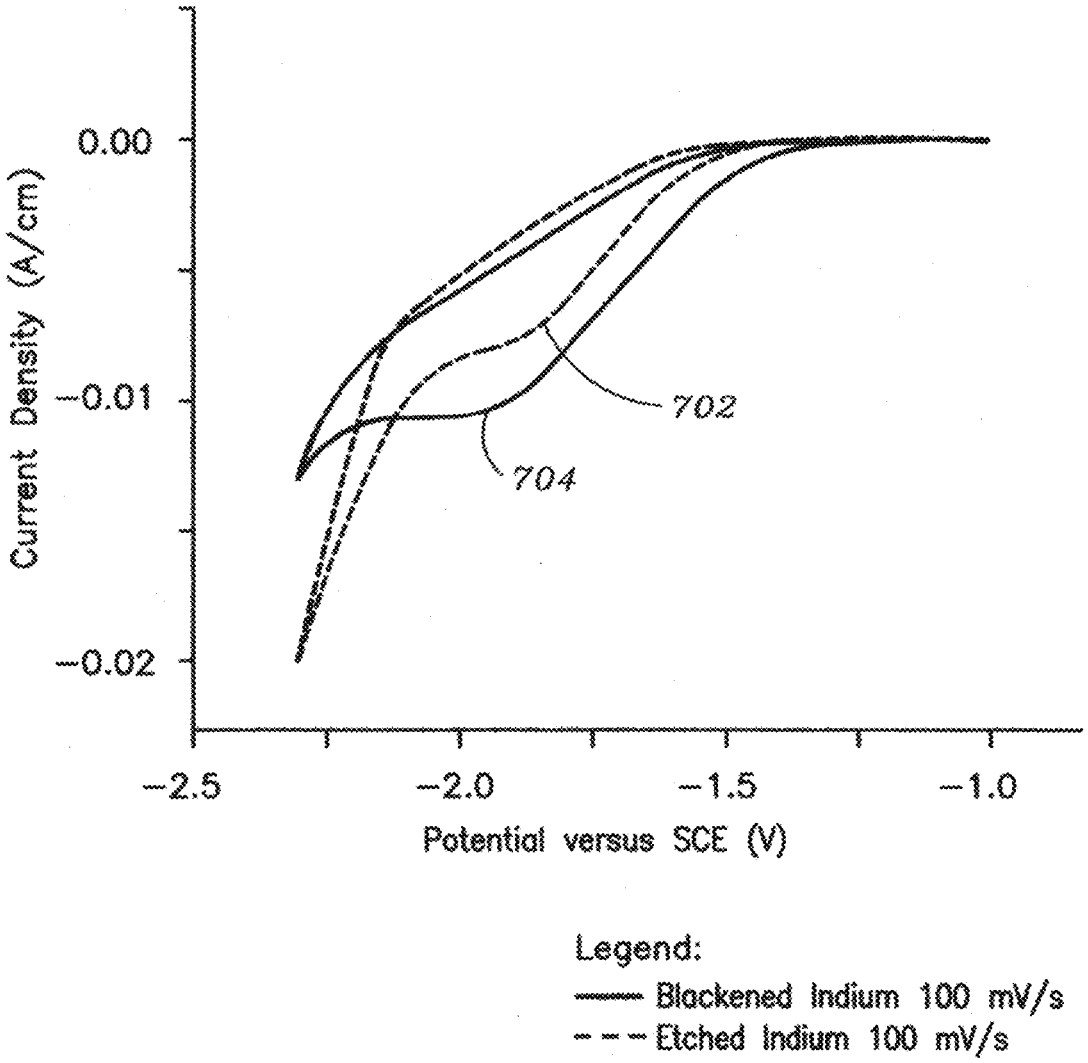
FIG. 7 is a graph of current density at potentials versus SCE.

The voltammetric response of the anodized indium electrode was directly compared to that of an acid etched indium surface. The indium electrode was etched with HCl and the resulting voltammogram is provided in FIG. 7 corresponding to curve 702. The same electrode was then anodized at +3V in KOH before electrolyzing at −1.4V in $K_2SO_4$ under $CO_2$ atmosphere for 2 minutes, ensuring a steady reduction current. FIG. 7 shows the voltammetric response of the treated electrode corresponding to curve 704, which experimentally demonstrates efficiency improvement. At the anodized electrode, onset of $CO_2$ reduction is more positive, peak current for the $CO_2$ reduction is increased, and the tail attributed to solvent reduction is suppressed. Moreover, $H_2$ formation is suppressed at the actively oxidized electrode. It was observed that as oxide layer thickness is increased there is no further Faradaic efficiency improvement. As a practical matter, as layers get thick, it is more likely that the anodized surface layer will flake off instead of reducing to the higher efficiency, formate-producing interface.

While the invention has been particularly shown and described with reference to the preferred embodiments thereof, it will be understood by those skilled in the art that various changes in form and details may be made without departing from the scope of the invention.

The invention claimed is:

1. A system for electrochemical reduction of carbon dioxide, said system comprising:

an electrochemical cell including:

a first cell compartment;

an anode positioned within the first cell compartment;

a second cell compartment;

a separator interposed between the first cell compartment and the second cell compartment, the second cell compartment containing an electrolyte, wherein said electrolyte is present as an aqueous solution; and an anodized indium cathode positioned within the second cell compartment, wherein said anodized indium cathode includes a layer of indium oxide electrolytically formed on an indium electrode; and an energy source operably coupled with the anode and the anodized indium cathode, the energy source configured to apply a voltage between the anode and the anodized indium cathode to reduce carbon dioxide at the anodized indium cathode to at least formate.

2. The system according to claim 1, further comprising a product extractor configured to continuously remove formate from the electrolyte.

* * * * *